US010087756B2

(12) United States Patent
Pecorari

(10) Patent No.: US 10,087,756 B2
(45) Date of Patent: Oct. 2, 2018

(54) RADIAL CYLINDER HYDRAULIC MACHINE WITH A DISTRIBUTOR EACH CYLINDER

(71) Applicant: S.A.I. SOCIETA' APPARECCHIATURE IDRAULICHE S.P.A., Modena (IT)

(72) Inventor: Vittorio Pecorari, Modena (IT)

(73) Assignee: S.A.I. SOCIETA' APPARECCHIATURE IDRAULICHE S.P.A., Modena (MO) (IT)

( * ) Notice: Subject to any disclaimer, the term of this patent is extended or adjusted under 35 U.S.C. 154(b) by 510 days.

(21) Appl. No.: 14/406,120

(22) PCT Filed: Jun. 6, 2013

(86) PCT No.: PCT/IT2013/000159

§ 371 (c)(1),
(2) Date: Dec. 5, 2014

(87) PCT Pub. No.: WO2013/183076

PCT Pub. Date: Dec. 12, 2013

(65) Prior Publication Data

US 2015/0159485 A1 Jun. 11, 2015

(30) Foreign Application Priority Data

Jun. 7, 2012 (IT) ..... MO2012A0150

(51) Int. Cl.
*F04B 1/04* (2006.01)
*F01B 1/06* (2006.01)
(Continued)

(52) U.S. Cl.
CPC ..... *F01B 1/0624* (2013.01); *F01B 13/067* (2013.01); *F03C 1/0415* (2013.01);
(Continued)

(58) Field of Classification Search
CPC ..... F04B 1/0452; F04B 1/047; F04B 29/00; F04B 1/0421; F04B 1/0465; F04B 7/0003;
(Continued)

(56) References Cited

U.S. PATENT DOCUMENTS 3,777,622 A * 12/1973 Hause ..... F01B 13/068 417/273
4,469,013 A * 9/1984 Poppi ..... F01B 15/002 91/495
(Continued)

FOREIGN PATENT DOCUMENTS

DE 37 26 957 A1 3/1989
EP 0 267 656 A2 5/1988
(Continued)

OTHER PUBLICATIONS

International Search Report in PCT/IT2013/000159 dated Sep. 12, 2013 (English Translation Thereof).

*Primary Examiner* — Dominick L Plakkoottam
*Assistant Examiner* — Philip Stimpert
(74) *Attorney, Agent, or Firm* — McGinn IP Law Group, PLLC

(57) ABSTRACT

A hydraulic machine includes radial cylinders including, oscillating radial cylinders arranged in a crown or star of cylinder-piston units, the pistons of the groups are made slidable on a crankshaft or with a cam, or on interposed members concentric to it, and realizing the reciprocating motion in the oscillating cylinders. The oscillating cylinders are placed in contact with a surface of distribution concentric or corresponding to the surface of oscillation of the respective cylinder on which a distributor body is placed separate from the machine body and housed in a seat in the body, or part fixed to the body, of the hydraulic machine, and each distributor body is mobile in its seat under the action of
(Continued)

the pressure of liquid in connection on the back surface of the distributor body against the surface of distribution of the oscillating radial cylinder subject to the distribution.

14 Claims, 9 Drawing Sheets

(51) Int. Cl.
*F03C 1/32* (2006.01)
*F03C 1/34* (2006.01)
*F03C 1/38* (2006.01)
*F01B 13/06* (2006.01)

(52) U.S. Cl.
CPC ..... *F03C 1/0435* (2013.01); *F03C 1/0444* (2013.01); *F04B 1/0421* (2013.01); *F04B 1/0452* (2013.01); *F04B 1/0465* (2013.01)

(58) Field of Classification Search
CPC .... F04B 7/0011; F04B 19/027; F01B 1/0624; F01B 13/067; F03C 1/0415; F03C 1/0435
USPC ..... 417/237, 464; 91/494, 495
See application file for complete search history.

(56) References Cited

U.S. PATENT DOCUMENTS 5,076,057 A * 12/1991 Maruno ..... F04B 49/126 417/221
5,619,232 A * 4/1997 Maeno ..... B41J 2/16508 347/30

FOREIGN PATENT DOCUMENTS

FR 1 530 605 A 6/1968
FR 2 296 778 A1 7/1976

* cited by examiner

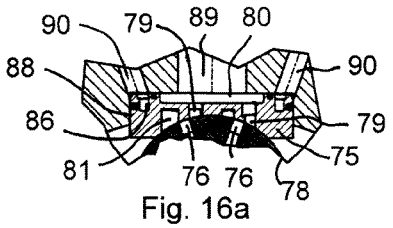
Fig. 16a
Fig. 16b
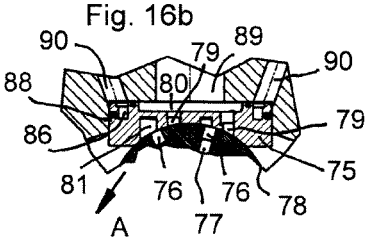
Fig. 16h
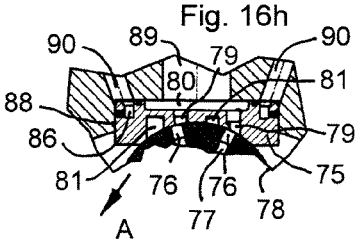
Fig. 16c
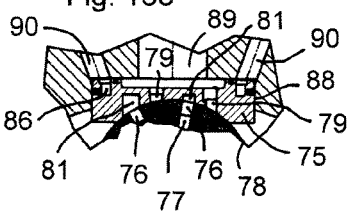
Fig. 16g
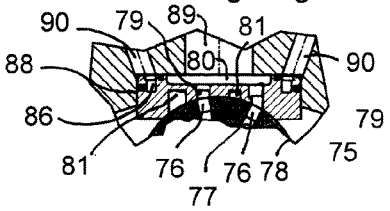
Fig. 16d
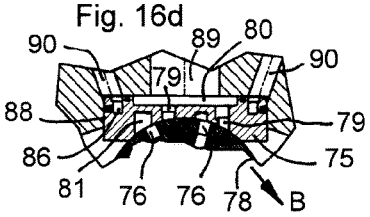
Fig. 16f
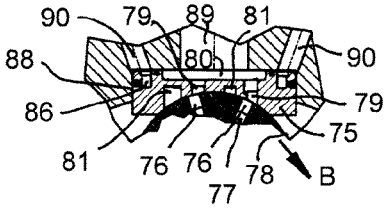
Fig. 16e
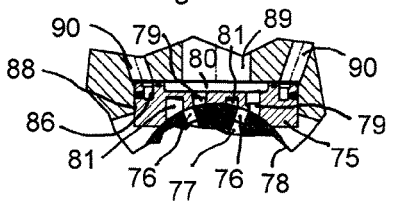

Fig. 17a
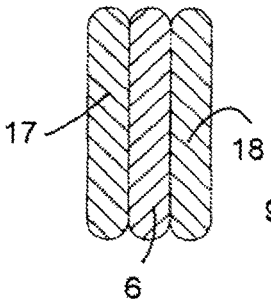
Fig. 17b
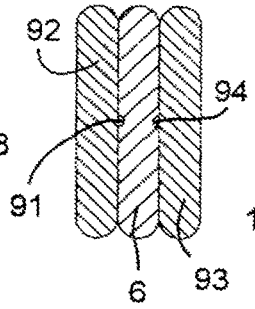
Fig. 17c
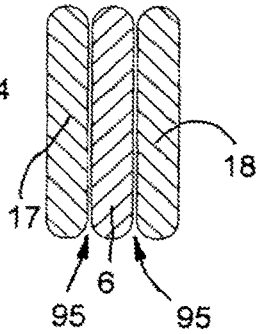
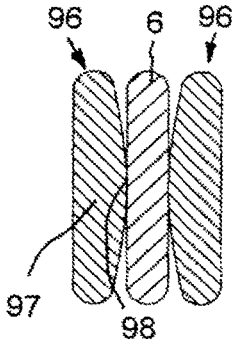
Fig. 18a
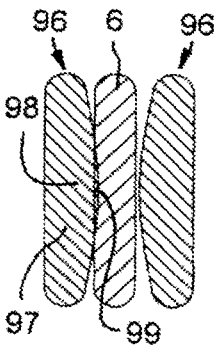
Fig. 18b
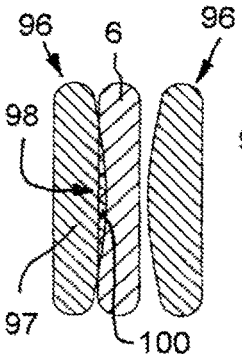
Fig. 18c
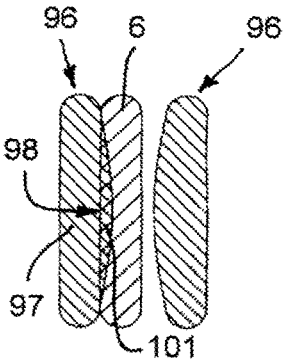
Fig. 18d

RADIAL CYLINDER HYDRAULIC MACHINE WITH A DISTRIBUTOR EACH CYLINDER

FIELD OF THE INVENTION

The present invention relates to a hydraulic machine with oscillating radial cylinders and single distribution members for each cylinder, that is to say, a hydraulic machine of the type known in the art, with radial cylinders, where cylinders arranged in a star pattern and acting on the same throw or crank of the motor shaft are placed in oscillation with respect to the body of the machine. Moreover, the distribution of the pressurized or discharge liquid is carried out in each cylinder individually and has improved characteristics with respect to the known art of radial hydraulic machines in order to achieve relevant technical-economic results with respect to it.

PRIOR ART

The prior art includes various types of radial hydraulic machines with cylinders arranged in a star pattern and in particular it includes solutions proposed to realize the distribution with the application of one single distributor for each cylinder in such a way as to have a better operation of the hydraulic machine and reduce its axial encumbrances.

In the art, as said above, these hydraulic machines are made in various ways in which a first way is to use the oscillation of the cylinder body to open and close ports on the surface of oscillation in their turn connected to channels of feeding and discharge, respectively, of the hydraulic liquid. A realization with these characteristics is described in the patent DE 359543 in which each cylinder has a cylindrical external surface with an axis parallel to the motor shaft in such a way as to make the cylinder and the piston oscillating, with reciprocating motion, with the coupling sliding on the throw of said motor shaft. At a diameter external to the cylinders there are annular channels with the delivery and discharge liquid and, between them and the surface of oscillation, two radial ports connecting each channel to a slit in the cylinder head in communication with its inside. The oscillation of the cylinder around its own axis determines the connection to one or the other channel and the passage in the intermediate position at the upper and lower dead centres of the piston with the closure of each passage of liquid from the cylinder to the channels.

Moreover, a similar solution makes it necessary to make the surface of oscillation of the cylinder tight, inasmuch as the ports, if they are not in connection with the port of the cylinder, must seal the pressurized liquid inside them with respect to the internal space of the hydraulic machine where the drawn liquid, that is to say, come out due to the inaccuracy of the seals and of the sliding surfaces in the oscillating or sliding motion of the parts, is collected, making the known solution unsuitable in the construction of current hydraulic machines with radial cylinders with high performances. They are known for their high rotation speeds and, in particular for the hydraulic motors, also for their minimum working displacements, being commonly built with variable displacement, and for the very high pressures reached in these conditions.

Therefore, in the art is known a second way of realizing the single distribution for each cylinder with a slide valve, controlled by the oscillating motion of the cylinder by means of cams or by means of the same oscillating motion of the cylinder and/or of the piston. In this second way of distribution of the feeding to the cylinder among the various solutions, also the document GB 2167138 is known, in which a radial hydraulic motor has a slide valve, single for each radial cylinder, which is controlled in an electronic way by a microprocessor on the basis of the values of the motor operation parameters connecting the respective channel with the liquid from or to the cylinder, to realize its operation.

A similar realization, even if adjustable in the best of the ways with the modulation and control of the opening and closing of the valve, makes the radial hydraulic motor very expensive and always needing electronic devices such as the sensors, the slide valves controlled by a solenoid and the microprocessor, so as to exclude its application in mobile machines or that, for safety reasons, cannot be equipped with electric installations. Moreover, the realizations of hydraulic motors with a slide valve, as one single distributor per cylinder, are expensive, due to the mechanical parts of connection between the valve and the oscillating cylinder-piston complex, and furthermore are highly sensitive to the impurities in the hydraulic fluid in such a way as to make the greater construction cost in the presence of more marked maintenance costs not convenient.

In the art hydraulic machines with radial cylinders with no liquid or fluid leaks are also known. An embodiment of these machines is described in the patent U.S. Pat. No. 6,511,306 in which the cylinders, four and opposite two by two and with the pairs of opposite cylinders at a right angle, are slidable from and towards a distributor sliding transversely to the axis of the cylinder and provided with a port of connection of the cylinder to respective delivery and discharge ports on the sliding surface. The avoidance of the leaks is obtained by making the sliding surfaces flat and providing the piston with a protuberance at the upper dead centre engages the connection port and translates the distributor on the sliding surface in an alternate way, like the motion of the piston within the cylinder, but cylinders associated at a right angle and connected to each other on a rigid cross. The delivery and discharge ports are made on a body inserted in the housing of the hydraulic machine, at the head to each cylinder, and housed with elastic elements, to press on the sliding distributor and prevent fluid leaks. Finally, the connection of the fluid delivery and discharge channels from the housing to an inserted body occurs on a surface parallel to the direction of axial sliding of the pistons, to eliminate the influence of the pressure forces, due to the pressure of the fluid, between the inserted body and the translating distributor.

Thus, if the realization described allows to achieve the aim of having no leaks, it is not applicable to usual hydraulic motors or hydraulic machines with many oscillating radial cylinders both due to the limitation in the direction of the movements, forcedly right-angled, and in the realization of a similar distributor for each of the radial cylinders to reach greater displacement in a very reduced encumbrance, after the complexity of construction described in the mentioned document.

The prior art are also comprises hydraulic machines with radial cylinders, as in document FR 2296778A1, in which a disc distributor is arranged coaxial to the motor shaft and rotating synchronously with it. The rotating disc distributor opens and closes with its motion the connection channel with a respective cylinder of one of the two crowns of radial cylinders of the specific realization described. The single cylinder is provided with a spherical surface of oscillation and put in contact with a spherical surface made mobile to maintain a constant contact pressure on the spherical surface of oscillation of the cylinder as pressure changes. The distribution is carried out by the rotating disc distributor maintaining long channels under pressure or discharge on the basis of the momentary connection ensured by the angular position of the distributor disc. This embodiment does not suggest any solution for the limits of the prior art seen in the previous prior documents, because it maintains the limits of most of the hydraulic machines with radial cylinders: a harmful volume of hydraulic liquid between the distributor and the cylinders and the pouring of hydraulic liquid between the body of the machine and the oscillating cylinder affects the distribution of the forces between the cylinder and the seat, in such a way as to have a different behaviour on the basis of the connection of the feeding channel when connected to the pressurized branch or to the discharging branch.

A hydraulic motor with radial cylinders, in which the cylinders have a spherical surface of oscillation with a centre of oscillation next to the centreline of the piston stroke in the cylinder, is also known from document FR 1530605. The distribution occurs by means of radial channels from the exterior of the spherical surface, from opposite areas of the surface and towards the centre with separate channels: on the one side an branch of the hydraulic circuit; on the other side the other branch of the hydraulic circuit to which the motor is connected. Therefore the distribution occurs by oscillation of the cylinder, which with the motion opens and closes the ports between feeder channels and the cylinder itself in such a way as to introduce or discharge the hydraulic liquid from the cylinder on the basis of the pressure of the branch that is connected to the cylinder and of the rotation of the motor shaft. Even if this embodiment shows how it is possible to realize the distribution without the aid of rotating (disc) or translating (slide valve) external means, the technical problem of balancing the pressure of the hydraulic liquid on the external surface of oscillation on the basis of which branch is under pressure. That is to say, only one of the branches being under pressure, the other is obviously connected to the exhaust, to carry out the passage of hydraulic liquid that generates rotational mechanical energy of the motor shaft. Therefore the surface of oscillation of the cylinder remains subject to a non-small pressure, but from time to time towards one side or the opposite side, on the basis of which branch is under pressure, creating overload and sliding wear inasmuch as, on the spherical surface, there is also the reaction of the thrust of the pressure internal to the cylinder always and anyway released on the spherical surface between the two side zones that perform the distribution. The deriving wear limits the use of such embodiment to hydraulic motors operating at relatively low pressures of liquid and low rotation speeds.

Such background art is susceptible of significant improvements as regards the possibility to make an improved radial hydraulic machine, of the type with oscillating cylinders, which overcomes the aforementioned drawbacks realizing a single distribution for each cylinder, in such a way as to reduce the encumbrances and the harmful spaces to distribute hydraulic fluid to the cylinders avoiding the drawbacks generated in the embodiments known in the art.

The technical problem, therefore, that is at the basis of the present invention is to make an improved radial hydraulic machine of the type with oscillating cylinders in which an effective and simple distributor operates in connection with each oscillating radial cylinder, avoiding leaks in all conditions of use, as well as it allows sealing also at high pressures, high rotation speeds of the machine as well as at the known operations with minimum oscillation angles.

An additional and further aim of the present invention is to realize the distribution in a radial hydraulic machine of the type with oscillating cylinders in which the passage of the fluid occurs in the best sealing and dynamic conditions also upon changing of the displacement in hydraulic motors that, notoriously, occurs by decreasing the angle of oscillation, maintaining acceptable the thrusts that are generated between the surface of the distributor and the sliding surface of oscillation of the radial hydraulic cylinder.

Finally, a further part of the technical problem mentioned above concerns the realization of an improved radial hydraulic machine of the type with oscillating cylinders in which the section of the feeding/discharge ducts from each cylinder realizes a constancy of the speed of passage of the fluid also in the presence of angles of oscillation of different size.

SUMMARY OF THE INVENTION

This problem is solved, according to the present invention, by a hydraulic machine, comprising oscillating radial cylinders arranged in a crown or star pattern of cylinder-piston units; the pistons of said units are made sliding on a crankshaft or with a cam, or on interposed devices concentric to it, and realize the reciprocating motion in the oscillating cylinders; characterised in that said oscillating cylinders are put in contact with a concentric surface of distribution or corresponding to the surface of oscillation of the respective cylinder on which a distributor body is placed separate from the machine body and housed in a seat in the body, or part fixed to the body, of the hydraulic machine; moreover, each distributor body is mobile in its seat under the action of the pressure of the liquid in connection on the back surface of said distributor body against the surface of distribution of the oscillating radial cylinder subject to the distribution.

Moreover, in an improved embodiment: each back surface, with respect to said surface of distribution, of said distributor body is divided into liquid tight zones with an equivalent area, in order not to influence sealing according to the direction of the motion of the hydraulic liquid.

Furthermore, in a preferred embodiment: said liquid tight zones, of the back surface of the distributor body, are made concentric and subdivided into a central zone and peripheral zone.

Moreover, in a further embodiment: each cylinder has a pair of slits for the connection of an branch of the hydraulic circuit to one or the other corresponding pair of distribution ports for the connection of an branch of the hydraulic circuit: the two pairs of slits being made interposed and with an angular position relative to the axis of the cylinder corresponding to the maximum oscillation in the operation of the oscillating hydraulic cylinder allowed to the machine.

Furthermore, in an advantageous embodiment: the connection between the respective liquid tight zone, be it central, peripheral or generic, and the corresponding opening or pair of ports is made with holes having a predetermined section.

Moreover, in an improved embodiment: each cylinder is hydraulically connected by means of the respective distributor body to annular channels of feeding and discharge of the hydraulic liquid.

Furthermore, in a preferred embodiment: in which each cylinder is hydraulically connected by means of the respective distributor body to internal channels of feeding and discharge of the hydraulic liquid from a static central body.

Moreover, in a specific embodiment: the feeding or discharge ports in the distributor body have a protuberance for anticipating or delaying the opening or closing of the passage of the hydraulic liquid of the distribution.

Furthermore, in a preferred embodiment: the ports are shaped with the edge facing the slit in the cylinder that has a swell to realize sections of passage of the hydraulic liquid variable with the variation of the angle of oscillation in the hydraulic motors working with reduced displacement.

Finally, in a specific embodiment: the hydraulic machine has a connection channel in each oscillation guiding trunnion and a respective distribution slit facing a corresponding single port on a single distributor body on each trunnion, having a surface of distribution corresponding to the surface of oscillation of the trunnions and of the cylinder as a whole.

The characteristics and the advantages of the present invention, in the embodiment of a hydraulic machine with oscillating radial cylinders and single distribution members for each cylinder, are mentioned in the description made in the following, of some schematic examples of execution given for indicative and non-exhaustive purposes, with reference to the nine tables of drawings enclosed.

SHORT DESCRIPTION OF THE DRAWINGS

Figure 1:
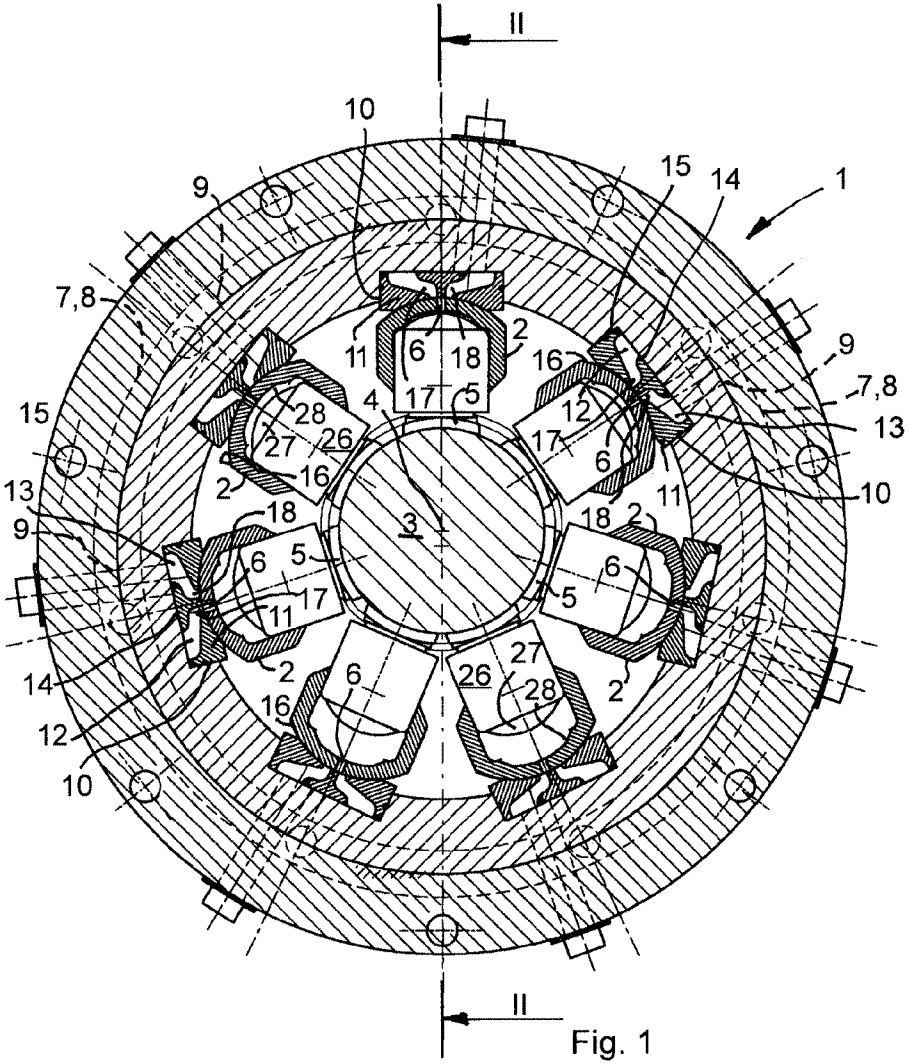
FIG. 1 shows a schematic section on a plane transverse to the axis of the motor shaft of a hydraulic machine with radial cylinders, here a hydraulic motor, in correspondence of the plane containing the cylinders of the star, according to the invention, provided with single distributors of the hydraulic fluid one for each cylinder at their external end of oscillation.
Figure 2:
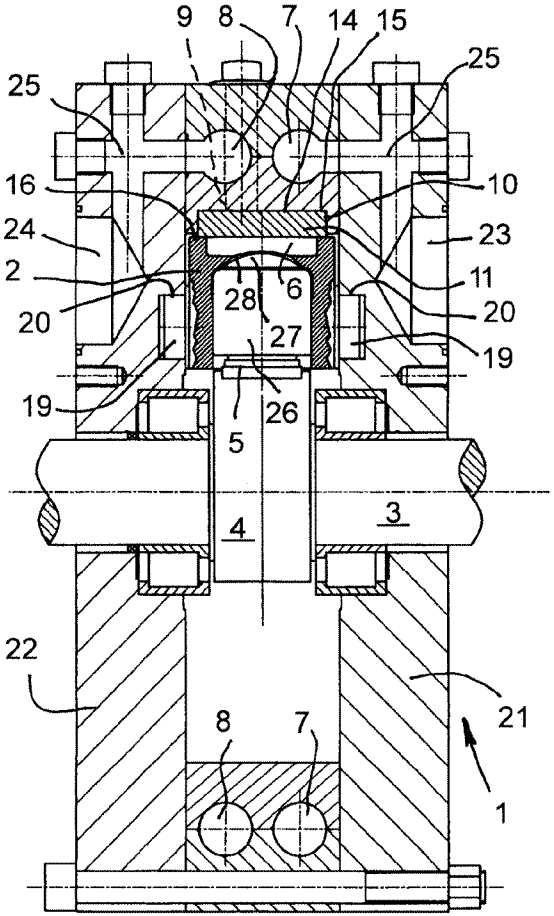
FIG. 2 shows a schematic section II-II of the hydraulic motor with radial cylinders of FIG. 1 made on a cylinder at the upper dead centre.
Figure 3:
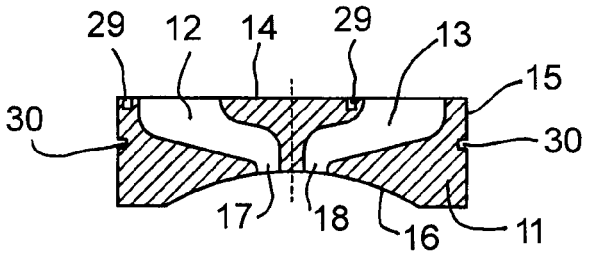
FIG. 3 shows a schematic section of a single distributor body present in the oscillation head of each cylinder of the hydraulic motor of FIGS. 1 and 2.
Figure 4:
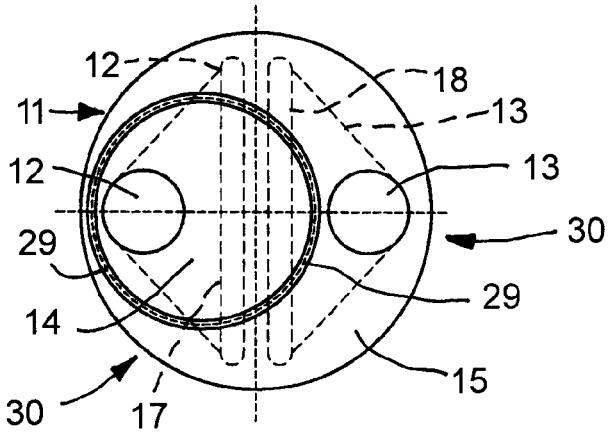
FIG. 4 shows a schematic view axial to the axis of the cylinder and from the side of the feeding and discharge channels of the hydraulic fluid, of the single hydraulic distributor of FIG. 3.
Figure 5:
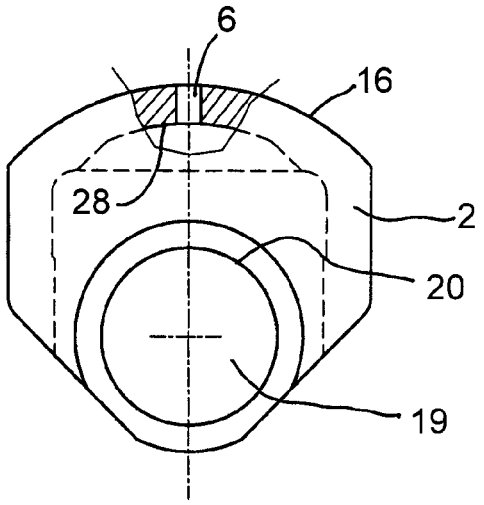
FIG. 5 shows a partially sectioned schematic view, in the surface of oscillation, of an oscillating cylinder of the hydraulic motor with radial cylinders of FIGS. 1 and 2.
Figure 6:
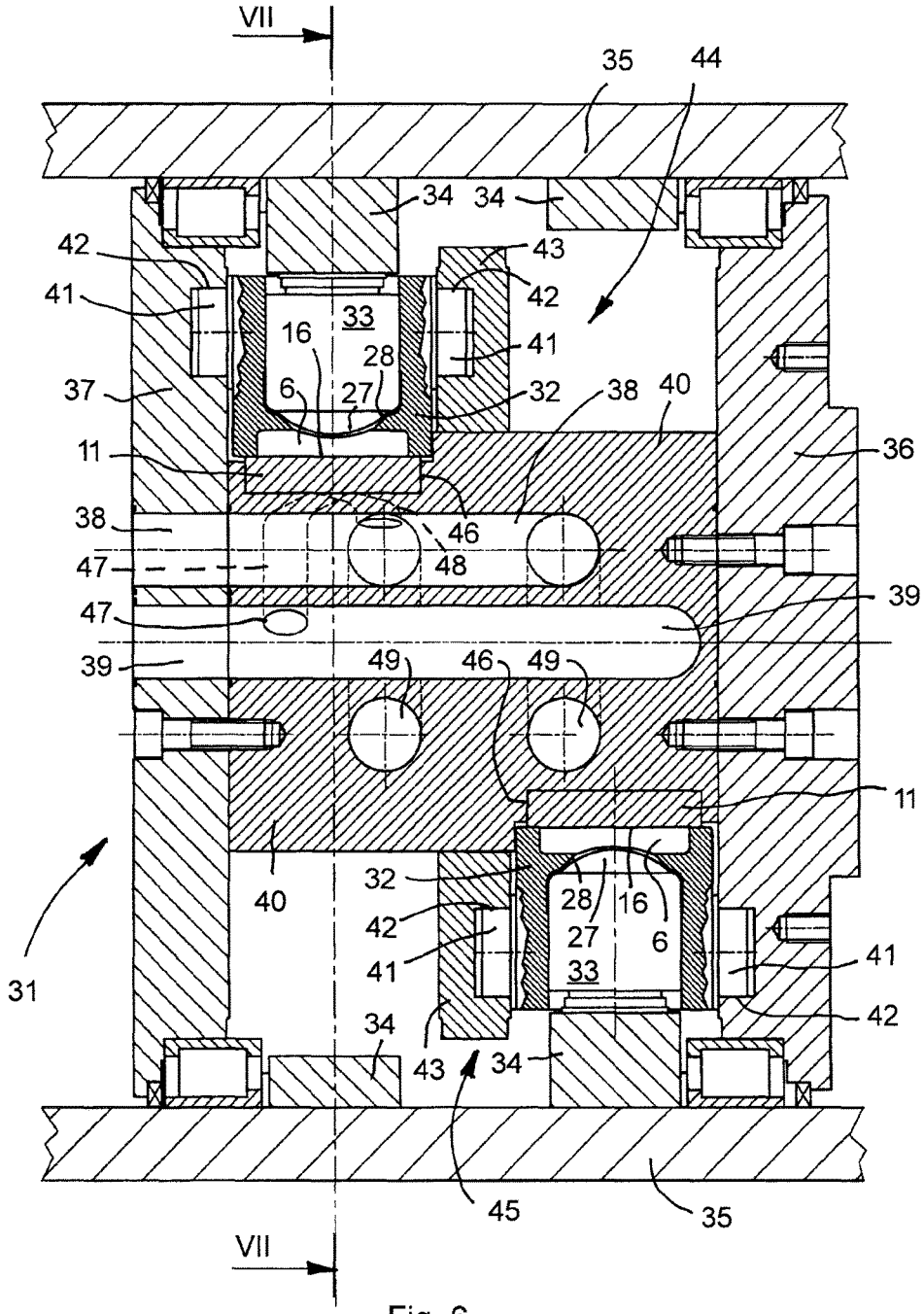
Figure 7:
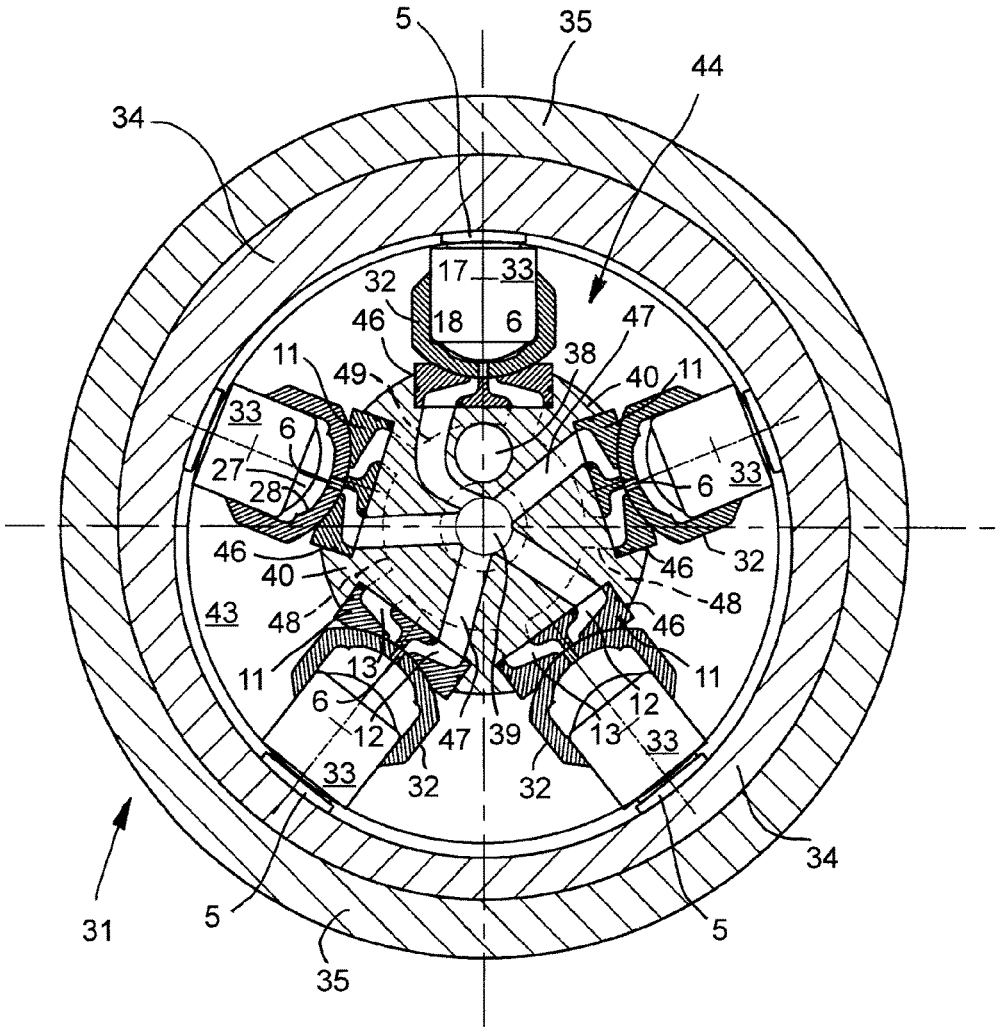
Figure 8:
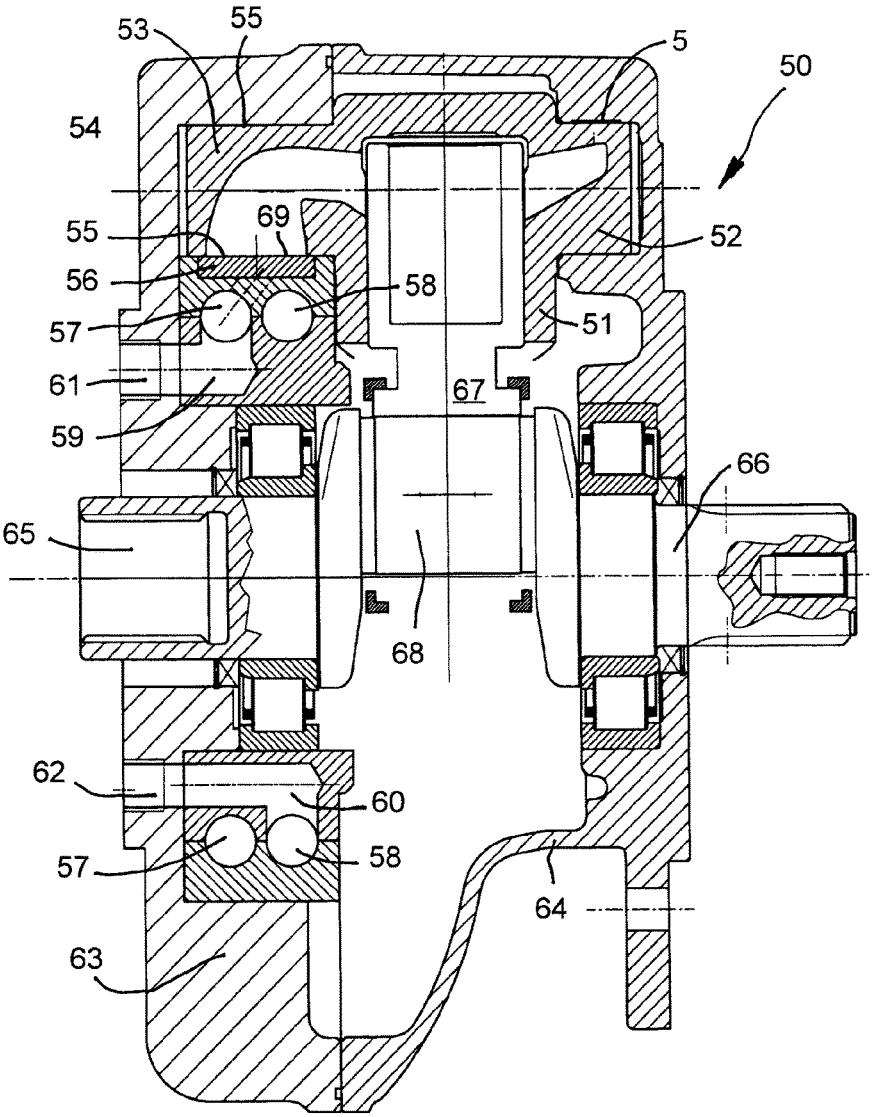
Figure 9:
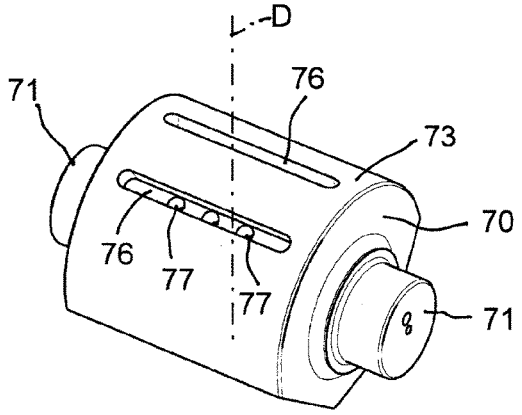
Figure 10:
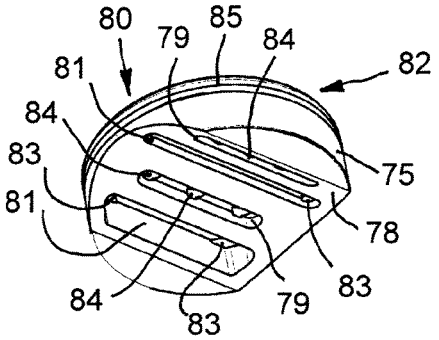
Figure 11:
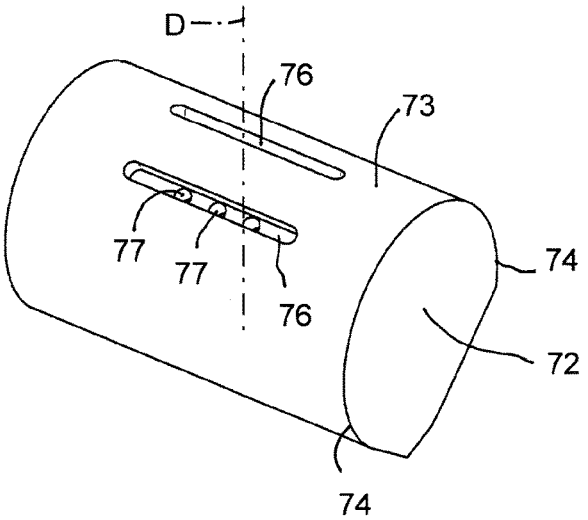
Figure 12:
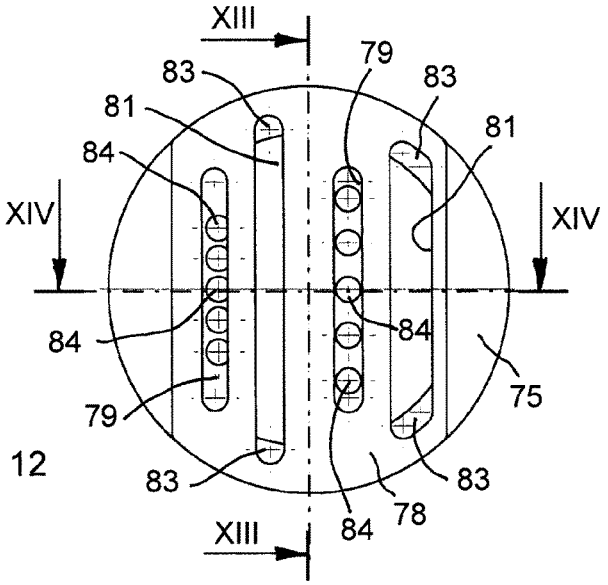
Figure 13:
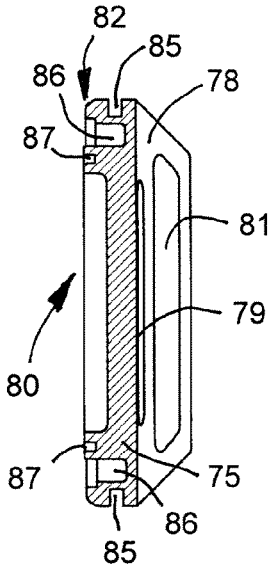
Figure 14:
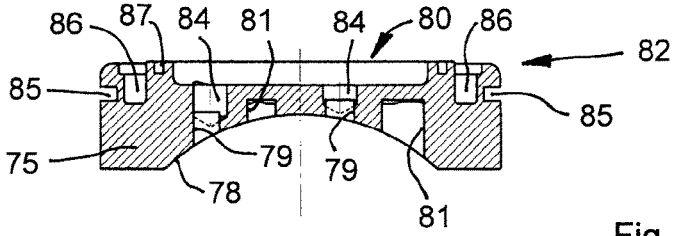
Figure 15:
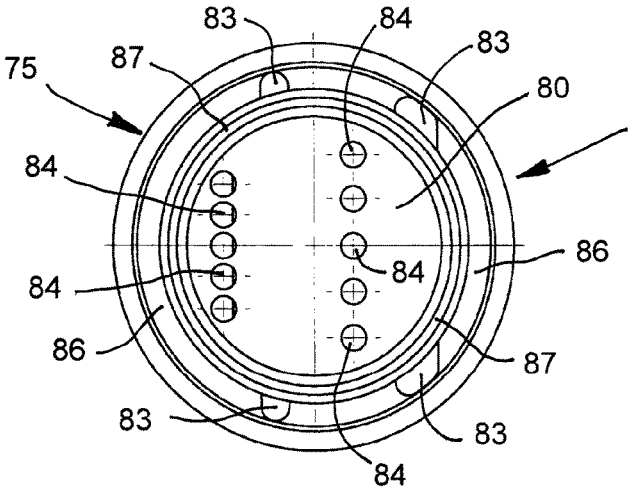

FIG. 6 shows a schematic view of a hydraulic machine with radial cylinders, here a hydraulic motor with a double crown of radial cylinders, wherein the cam is external and the central pin acts as a support and body with the channels of feeding/discharge of the hydraulic fluid: it is used in the power-operated wheel centres because it has the external skirt rotating with the cams to constitute a hollow motor shaft;

FIG. 7 shows a schematic section on a plane transverse to the axis of the motor shaft of a hydraulic machine with radial cylinders, here the hydraulic motor of FIG. 6, in correspondence of the plane containing the cylinders of a star, according to the invention, equipped with single distributors of the hydraulic fluid, one for each cylinder at their oscillating internal ends;

FIG. 8 shows a schematic section on a diametral plane containing the axis of the motor shaft of a hydraulic machine with oscillating radial cylinders on trunnions, here a hydraulic motor, in correspondence of the plane containing a cylinder and its axis of oscillation, according to the invention, and equipped with single distributors of the hydraulic fluid, one for each cylinder, on one of the two trunnions;

FIG. 9 shows a schematic perspective view of an oscillating hydraulic cylinder, similar to that of FIG. 1, 2 or 5 in which the connection slit of the hydraulic cylinder with the ports has a spilt arrangement to increase the section of passage;

FIG. 10 shows a schematic perspective view of a distributor for oscillating hydraulic cylinder, similar to that of FIG. 1, 3 or 4 in which the delivery/discharge ports of the distributor have a split arrangement to increase the section of passage towards the connection slits of the hydraulic cylinder of FIG. 9;

FIG. 11 shows a schematic perspective view of an oscillating hydraulic cylinder, similar to that of FIG. 1, 2 or 5, and wherein the connection slit of the hydraulic cylinder with the ports has a split arrangement to increase the section of passage, as well as the oscillation of this cylinder is provided on the sealing surface of the hydraulic distributor;

FIG. 12 shows a schematic view of a distributor like that of FIG. 10 from the side of the surface of oscillation of the cylinder;

FIG. 13 shows a schematic diametral section XIII-XIII of the distributor of FIG. 12;

FIG. 14 shows a schematic diametral section XIV-XIV of the distributor of FIG. 12;

FIG. 15 shows a schematic view from the side of the channels of feeding/discharge of the distributor of FIG. 11;

FIGS. 16*a* to 16*h* schematically show the movement of oscillation of the pair of slits on the cylinder with respect to the pair of ports of the distributor of FIGS. 12 to 15, during the cycle of a complete oscillation of the cylinder in sequence from 16*a* to 16*h;*

FIGS. 17*a*, 17*b* and 17*c* show a schematic representation of the shapes of the ports with respect to a generic central slit of an oscillating cylinder, with no overlap, FIG. 17*a*, negative overlap, FIG. 17*b*, or positive overlap, FIG. 17*c*, respectively;

FIGS. 18*a* to 18*d* schematically show a shape of the ports with respect to the generic central slit of an oscillating cylinder, according to the invention, with no overlap, in the position at the dead centres, and in three different phases of opening with a low angle of inclination of the respective cylinder in the oscillation, evidencing the progressiveness of the port of the section of passage between the involved port and the slit.

DETAILED DESCRIPTION OF PREFERRED EMBODIMENTS

In FIGS. 1 and 2, in a first embodiment of a single distributor for oscillating cylinder, according to the invention, one can see a hydraulic machine 1, here is represented a hydraulic motor with radial cylinders 2 arranged in a star pattern, placed to slide on a motor shaft 3, with a cam to constitute the crank 4, by means of known shoes 5 of the single piston. On the head of each cylinder there is a slit 6 of communication with annular channels 7 and 8, to the star of cylinders, to carry out the delivery and the return of the hydraulic fluid for operation. Each annular channel is provided, towards each cylinder, with a fluid feed radial duct 9. The two radial ducts 9 connected to a respective cylinder 2 feed the fluid in a seat 10 for housing a distributor body 11, housed with play, but sealed in said seat: each radial duct 9 is connected to a different zone of the surface of the distributor body, but on the same side, the zones are provided with a separation seal between them and towards the inside of the hydraulic machine. The distributor body 11 has on its inside shaped ducts 12 and 13, respectively, to put in hydraulic connection the different zones 14 and 15, respectively, of said distributor body with the oscillating cylinder 2 on the cylindrical surface of distribution 16, where there is the passage of the hydraulic fluid from the distributor body, through ports of distribution 17 and 18 corresponding to said shaped ducts 12 and 13, to realize the alternate passage in delivery and in discharge of the hydraulic fluid through said slit 6 at each of the two annular channels and the respective cylinder 2 as required by the instantaneous phase of the cycle.

Furthermore, the cylinder 2 has trunnions 19 for defining an axis of oscillation with respect to which the cylindrical surface of distribution 16 is centred, that is to say, the oscillation occurs by means of the guide of the rotation surfaces 20 of the trunnions, which are connected in a rotating manner to the walls 21 and 22 of the hydraulic machine 1; each of the annular channels 7 and 8 is connected with a respective attachment 23 and 24 of the duct of the hydraulic circuit, on said walls of the hydraulic machine, by means of holes 25 in said walls. Therefore, the piston 26 is provided with a crown 27 which at the upper dead centre occupies the high part 28 of the cylinder 2 considerably reducing the harmful volume that remains occupied by the fluid. Moreover, in FIG. 3 one can see the seat 29 of the front seal, for the zone 14 of the shaped channel 12, as well as the seat 30, for the circumferential seal of the zone 15 of the shaped channel 13.

The sizing of the zones 14, of the shaped channel 12, and zone 15, of the shaped channel 13, are calculated in such a way as to have the same surface and, therefore, the thrusts generated through them by the pressure of the hydraulic fluid are almost identical in proportion to the pressure. The pressure, which is present in the cylindrical surface of distribution 16, is balanced by the constancy of the pressure due to the equality of the surfaces of the zones 14 and 15, in such a way as to ensure a balance of the thrusts on the body distributor 11 and limit the thrusts between the trunnions 19 and the rotation surfaces 20 of the latter. The constancy of the thrust between the distributor 11 and cylinder 2 ensures the sealing on the surface of distribution also in the absence of specific holding means, because the mobility of the distributor body does not transfer all the thrust of the hydraulic liquid on the cylinder in the surface of oscillation of the trunnions, but only the residual thrust not compensated for between the thrust of the hydraulic liquid in the cylinder and the thrust on the surface of distribution.

In FIGS. 6 and 7 one can see a further embodiment of hydraulic machine 31 with radial cylinders 32 arranged in a star pattern and having each piston 33 sliding on the internal cam 34; the cylinders are subdivided, in the representation of the hydraulic machine, here a hydraulic motor, on a double crown of cylinders and in which the internal cams 34 are connected and rotating with a hollow motor shaft 35, which is usually known to constitute a wheel centre with hydraulic motor, housed directly inside the driving wheels of a vehicle. The hydraulic machine 31 has a side wall 36, of connection to the supporting structure, not shown here, and a side wall 37 of attachment of an off-axis duct 38 and an axial duct 39, for the feeding and discharge hydraulic fluid to it; said ducts are extended in a static central body 40 of the hydraulic machine 31.

As it can be seen in the Figures, each cylinder 32 is supported in its oscillation by means of trunnions 41 on the rotation surface 42, in a way similar to the cylinders 2; there being two crowns of cylinders arranged in a star pattern, between them is provided an intermediate support ring 43 of the rotation surfaces 42 of the trunnions 41 between the two crowns 44 and 45 of oscillating cylinders. Each cylinder 32 is constituted in a way similar to the cylinder 2 with a slit 6 in contact with a surface of distribution 16 of a distributor body 11. Each piston 33 has a shoe 5 sliding on said cam 24 of the crown 44, 45 of the cylinders arranged in a star pattern. Moreover, the piston 33 has a crown 27 which at the upper dead centre occupies a high part 28 of the cylinder 32, to reduce the harmful volume of hydraulic fluid that at every cycle remains inside the cylinder. Thus, as visible, each duct 38 or 39 in the static central body 40 is connected to a seat 46 of the distributor body 11 by means of connection channels, respectively, 47, from the axial duct 39, and 48 from the off-axis duct 38; the latter in correspondence of each crown of cylinders has an annular duct 49 to allow for the connection of the corresponding channels 48 of each cylinder, avoiding the central part of the static central body 40, that is to say, where there is the axial duct 39.

In FIG. 8 one can see a further embodiment in which a usual hydraulic machine 50 with radial cylinders, here advantageously in the form of a motor, with the cylinders 51 oscillating on axes of oscillation defined by trunnions lateral to the oscillating cylinder, a supporting trunnion 52 and a trunnion of feeding 53 and discharge of the hydraulic fluid, which occurs by means of a channel 54 in the trunnion. In the rotation surface 55 of the trunnion of feeding 53 there is a distributor body 56, similar to the body 11 described at the head of the cylinders 2 or 32, here to connect for the distribution adjacent annular channels 57 and 58, internal to said rotation surface 55, for the delivery and discharge, which acts simultaneously as a surface of distribution of the hydraulic fluid. The annular channels 57 and 58 are connected by ducts in the axial direction 59 and 60, respectively, to the attachments 61 and 62 of feeding and discharge from the hydraulic circuit in which the hydraulic machine 50 is connected. In this way the side cover 63 of the motor case 64 allows for the passage of a second end 65 of the motor shaft 66 wherein, in the known embodiments, a rotating disc distributor is generally housed for the delivery/discharge of the hydraulic fluid from the cylinders. Finally, a usual piston 67 is placed in sliding contact on the crank 68 of the motor shaft in a known way. For similarity of construction the distributor body 56 is constituted and operates in a way similar to the already described distributor body 11. The distribution therefore occurs by the oscillation of a slit 69 present in the rotation surface of the trunnion of feeding 53 in correspondence of ports, in the distributor body towards the annular channels through the surface of distribution, ports connected to said annular channels 57 and 58, as described for the previous embodiments.

In FIGS. 9 and 11 one can see embodiments of an oscillating cylinder 70 with rotation trunnions 71 and an oscillating cylinder 72 where the rotation surface 73 coincides with the surface of distribution and the function of positioning to rotation is performed by parts 74 of the surface of oscillation undercut with respect to the radial direction of positioning of the cylinder in the star of cylinders of the hydraulic machine in which they are inserted. In FIG. 10 one can see a distributor body 75, similar to the distributor bodies 2 and 32, with a different arrangement of the ports and of the shaped channels of distribution from and towards the oscillating cylinder. That is to say, the oscillating cylinders 70 and 72 have a double connection slit 76 through the surfaces of distribution with an increased section of passage with respect to the previous ports 6 or 69 because it is determined not by the width of the slits, but by the holes 77 present in them, which connect the surface of distribution 73 to the inside of the oscillating cylinder 70 or 72.

Each of the two slits 76 is positioned at a radial angle, with respect to the axial direction D of the centreline of the relative oscillating cylinder 70 or 72 at an angle greater than the corresponding maximum angle of oscillation of said cylinder. In this way each single slit 76 behaves like a slit 6 or 69 of a distributor body 11 or 56 with the relative oscillation of the surface of distribution 73 of the cylinder on the surface of distribution 78 of the distributor body 75 with split ports 79, for a connection of the hydraulic fluid from a central zone 80, of connection of the shaped channels, and 81, for the connection of the hydraulic fluid from a peripheral zone 82, on the corresponding and opposite branch of the hydraulic circuit in the operation of the hydraulic fluid in delivery or discharge. The connection between the peripheral zone 82 and the ports 81 occurs by means of peripheral holes 83 between said zone and the ports; thus, the connection between the central zone 80 and the ports 79 occurs by means of central holes 84; thus the peripheral zone is delimited on the external diameter of the distributor body 75 by means of a seal housed in a circumferential hollow 85.

In FIGS. 12 to 15 the shape is clearly shown with the already indicated numerical references; moreover, 86 indicates an annular channel in the peripheral zone 82 for distributing hydraulic fluid to the peripheral holes 83 in a uniform way; 87 indicates a front annular seat for a seal of delimitation between said peripheral zone 82 and said central zone 80.

FIGS. 16*a* to 16*h* show the reciprocal oscillating movement between a distributor body 75, housed in its seat 88, of a generic motor case of a hydraulic machine with radial cylinders, on which a central duct 89, of feeding of the central zone 80, and peripheral ducts 90, of feeding of the peripheral zone 82 converge. In the sequence of the phases one can clearly see the following positioning of the slits 76 on the surface of distribution of the oscillating cylinder, in contact with the corresponding surface of distribution 78 in the distributor body 75. In FIG. 16*a*, with the cylinder and the piston at the upper dead centre, the slits 76 are in the closing position with respect both to the ports 81 of the peripheral zone and to the ports 79 of the central zone of the distributor body; then, in the following, FIG. 16*b*, the oscillation in the direction A of the cylinder begins the opening of the passage of hydraulic fluid from the ports 81 of the peripheral zone in the slits 76; in FIG. 16*c* the amplitude of the oscillation towards A is maximum, so FIG. 16*d* shows the return oscillation motion in the direction B of the cylinder, until reaching, at the lower dead centre, FIG. 16*e*, the closing position of the ports, both of the peripheral zone 81 and of the central zone 79, with respect to the slits 76. So again in the oscillation in the opposite direction, in FIG. 16*f* one sees that the slits 76, in the oscillation of the cylinder in the direction B, are put in communication with the ports of the central zone 79, until reaching the complete opening, in FIG. 16*g*; and, moreover, the completion of the cyclical oscillation motion can be seen in FIG. 16*h* in which, with a following oscillation in the direction A from the position of complete opening, of the ports of the central zone 79 towards the slits 76, the oscillation motion of the cylinder causes the closure of the passage of hydraulic fluid from the ports 79 of the central zone of the distributor body 75 towards the cylinder through the slits 76. At the end of the cycle of oscillation the position of the slits and of the ports in the distributor body 75 returns that of FIG. 16*a*, that is to say, again with the cylinder and the stroke of the piston in it at the upper dead centre.

FIGS. 17*a*, 17*b* and 17*c* show the embodiments of a single slit like 6 or 69 of the arrangements with a distributor body 11 for single slit in the corresponding oscillating cylinder 2 or 32 or even in the trunnion of feeding 53. In fact, the ports 17 and 18 are made with no detachment or overlap with respect to the width of the slit 6, as shown in FIG. 16, in such a way as to realize no overlap, that is to say, a clear opening/closing of the passage of hydraulic fluid and with no possibility also of partial mixing of the flows of hydraulic fluid. In the case, on the other hand, of realizing a gentler or softer way of opening and closing of the hydraulic flow of fluid through the ports of delivery and discharge, there is provided a small protuberance of advance 91 towards the slit 6 of a port 92, for example the left one in FIG. 17*b*, so that, in the opening of the passage of fluid at the dead centres of the piston of the cycle of oscillation of the cylinder, the fluid begins to flow also a moment before the effective opening of the port; in a similar way the port 93 of the branch of the opposite hydraulic circuit has a small protuberance of delay 94 towards the slit 6, which maintains slightly in communication the port 93 with the slit 6 also in the position of centred overlap shown in FIG. 17*b*. This arrangement of the protuberances that anticipate and delay the passage of hydraulic fluid between the ports 92 and 93 and the slit 6 makes a negative overlap, that is to say, allows for a short mixture of the flows of hydraulic fluid inflowing/outflowing from the oscillating cylinder decreasing their noise and vibrations and realizing a gentle and soft operation of the hydraulic machine on which they are made. In particular embodiments, then, if precision and safety of the operation of distribution are required, the overlap can be made greater than the simple port of the slit 6, as shown in FIG. 17*c*, in it in the position of passage at the so-called dead centres of the oscillation of the cylinder between the slit 6 and the ports 17 and 18 of delivery/discharge of the distributor body there remains, due to construction, a thin overlap strip 95 in which the oscillation between the ports and the slit occurs, but not the passage of the hydraulic fluid between them, to make a positive overlap of distribution.

As visible, finally, in FIGS. 18*a* to 18*d* that show successive moments of port of the passage from a shaped port 96 of the hydraulic fluid, the constitution of the ports of delivery/discharge of the hydraulic fluid from the oscillating cylinder can occur also with a variable section of passage of the port with the increase/decrease of the amplitude of oscillation of the cylinder. This particular construction is useful in hydraulic motors with oscillating radial pistons and variable displacement, that is to say, which from a maximum value can be reduced to a minimum value, without for this reason cancelling the displacement, that is to say, the amplitude of oscillation; the motor, not having displacement would behave like a closed—that is to say—locking valve, failing its function of transforming the motion of the hydraulic fluid into rotational motion of the motor shaft. Said specific Figures show a variable port 97 to the left of the slit 6 and in a position of no overlap, as said for FIG. 17*a*; here, however, the variable port 97 has a swell 98 facing the slit 6 to open a minimum passage 99 of hydraulic fluid with a small angle of oscillation, FIG. 18*b*. As oscillation increases, the swell 98 opens the passage of hydraulic fluid in a more consistent way, as can be seen in FIG. 18*c*, of an increased passage 100, and 18*d*, of a complete passage 101, in which the hydraulic fluid finds the port 97 almost completely open on the edge of the slit 6 facing it.

The operation of the radial hydraulic machine described above, provided with oscillating cylinders 2, 32, 70 or 72 with one single distributor for each cylinder, occurs by the oscillation of the cylinder that, as known in the art, opens and closes the respective ports of feeding or discharge of the hydraulic liquid. Moreover, the present invention introduces a new solution in the way of realizing and operating the position of the ports of feeding and discharge and such as to significantly modify the way of construction of the hydraulic machines with oscillating radial cylinders in which it is applied.

In fact, as it has been seen in the prior art, the main disadvantage was the sealing security of the ports on the surface of oscillation, which is also the surface of distribution of the hydraulic liquid from the body of the machine to the oscillating cylinder, for the correct operation. Mainly the pressure of the hydraulic liquid in one of said ports is generally different from the pressure in the other. In the solution proposed by the present invention this pressure, besides being present in the port, is also present in a back surface of the distributor body 11, 56 or 75, that is to say, in the sealing zones 14 or 15 or in the central zone 80 and peripheral zone 82, with respect to the cylinder head, in such a way as to push said body against the surface of oscillation of the cylinder. Moreover, the ports are always at least two, so considering the port with greater pressure, the other is obviously connected to the branch of the hydraulic circuit in discharge, it is the same pressure that acts inside the cylinder 2, 32 or 75. In order to realize the most convenient operation of the distributor body 11, 56 or 75 described above, the force exerted by said pressure acts on the back face of the distributor body itself and ensures its contact, on the surface of distribution 16, 55 or 78, in all operating conditions of the hydraulic machine and, moreover, the residual thrust from the compensation of the axial force developed in the oscillating cylinder by the pressure of the liquid that opposes it is the only one that is released through the surfaces of oscillation 20, 42 or 55 of the trunnions 19, 41 or 53 of the cylinder; that is to say, the thrust on the trunnions is reduced to values limited to the guide of the cylinder in the oscillation, but is not subject to the strong thrusts that are generated in the hydraulic machine with the oscillating cylinders provided with trunnions known in the art. Thus, considering that the high pressure can indifferently be present in one or the other of the ports of feeding or discharge, the back surface of the described distributor body is divided into two areas having an equivalent surface. In this way it is indifferent which of the two branches is under pressure and which in discharge: in any case the pressure that acts on the distributor body 11, 56 or 75 realizes the greatest thrust towards the surface of distribution in order to ensure tightness in the passage of the hydraulic liquid from the ports to the slit in the oscillating cylinder.

Said operation does not comprise completely the embodiment of FIG. 8 because the trunnions in it make up the support to the oscillation in the known way and also the surface of distribution, but said realization allows to free the encumbrance caused by the known disc distributor, arranged axially to the motor shaft, therefore to be able to realize hydraulic machines with a double connection of the motor shaft on both sides as visible in the Figure. Moreover, said construction shown is specifically a hydraulic motor with oscillating radial cylinders and, with the present invention, the change in the position of the distributor, from the usual of the disc type in a position axial to the shaft in the new represented shape, can also be made on hydraulic machines, or better hydraulic motors, already built, that is to say, it can be applied in a second moment with respect to the construction, or, can be made making only partial changes without designing a new hydraulic motor with oscillating radial cylinders with trunnions.

The operation, instead, of the embodiment of the distributor body of FIG. 9 and FIGS. 12 to 15 is explained by the sequence of the phases of operation, that is to say, of oscillation of the cylinder of FIGS. 16*a*-16*h*, in which one sees that fundamentally the behaviour of the distributor body 75 operates in the way described above for the previous embodiment. The difference consists of the shape of the two slits 76 shown in the surface of distribution 73 of the cylinder; each slit is connected inside the cylinder through holes 77, which determine the section of passage of the hydraulic liquid, in such a way as to obtain a wide section of passage of hydraulic liquid, wider than that obtainable from the single slit 6 of the cylinders 2 or 32. Correspondingly the surface of oscillation 78 of the distributor body 75 has pairs of ports 79 and 81 angularly placed to simultaneously perform the closing of the ports at the dead centres of the stroke of the piston in the cylinder and the port of one or the other pair of ports, when opposite said pair of slits, during oscillation. Each port is connected to the back surface of the distributor body 75 with central holes 84, to connect the ports 79 to the central zone 80, and with peripheral holes 83, to connect the peripheral zone 82. The development of the two surfaces of the central and peripheral zone are similar and slightly greater than the area developed by the bore of the cylinder involved at the distributor body. The sections of passage from said zones on the back surface of the distributor body and the pairs of ports 81 and 79 are defined by said peripheral 83 or central holes 84.

Finally, the distribution ports 17, 18 or 79, 81 can, in order to realize gentler and less loud operations in the opening and closing of the passage of hydraulic liquid between them and the corresponding slit in the cylinder, be provided with contact edges with negative overlap, even if it is made only at one point of the side of the port, as visible in FIG. 17*b* in which the ports 92 and 93 re provided with protuberances 91, of advance, and 94 of delay, respectively, in such a way as to realize even a very short passage of liquid from one port to the other, thus limiting the drops of pressure of the liquid in the cylinder. In a similar way, if a secure closure of the ports is required, it is possible to realize a positive overlap with an overlap strip 95 between the ports and the edges of the slit 6.

With the specific shape of the edge of the ports, as shown in FIGS. 18*a* to 18*d*, the edge itself can be made not linear in such a way as to make progressive, with the respective angular position reached, the section of port of the passage of a port with respect to the slit in the cylinder, where a so shaped distributor body act. In fact, in FIG. 18*a* the two shaped ports 96, drawn close to the slit 6, realize a variable port 97 because they are of a shape with a swell 98 of the edge of the port drawn close to the slit 6. In this way the passage of the relative position of the slit 6 towards a shaped port 96 generates an increasingly wide section of passage as, in the motion of oscillation of the cylinder, the slit 6 moves towards the shaped port 96 enlarging on the section of passage, but not in a sudden way: from the minimum passage 99 to the increased passage 100 to the complete passage 101 in which the front of the opening is almost completely open because of the variability of the side of the port due to the swell 98. In this way in the operation of hydraulic machines with reduced displacement, typical of the hydraulic motors operated with minimum displacement, the section of passage of the hydraulic fluid allows to keep the speed of the hydraulic liquid in the passage of the port constant.

The advantages in the realization and use of a hydraulic machine, with oscillating radial cylinders provided with a distributor for each single cylinder as described above, are expressed by a simple construction, for the realization of the distributor that, being made very close to the cylinder, does not need long connection channels of the single cylinder with the distributor, reducing the volume of hydraulic liquid between the cylinder and the surface of distribution, with respect to the distribution realized with the rotating discs known in the art.

Moreover, the distribution of the hydraulic liquid by the described distributor body 11, 56 or 75 allows to balance in a correct way the sealing of the liquid in the surface of distribution 16, 55 or 78 both for the thrusts transmitted on it and for the reduction of the thrusts on the trunnions 19, 41 or supporting surface 20, 42 or 73 and 74, and guide in the rotation of oscillation of the cylinder involved. That is to say, the possibility of movement allowed to the distributor body 11, 56 or 75 allows to realize the distribution of the hydraulic liquid as precisely as possible with respect to the known art.

The realization of the single distributor for each cylinder, as visible in the Figures, allows to make hydraulic machines, in particular hydraulic motors, that, besides reducing axial sizes and encumbrances, allow for the construction of motor shafts 3 or 35 with two free ends 65 and 66 and this is also possible on already built hydraulic machines or hydraulic motors.

Moreover, the realization of double slits 79 and 81 rather than one single slit in the cylinder 70 or 72 allows to increase the section of passage of the hydraulic liquid in the surface of distribution 73, so the distributor body 75 is more balanced as the zones of pressure on its back surface are concentric to a central zone 80 for two ports 79 and a peripheral zone 82 for the other two ports 81.

Furthermore, the described shape of the distribution ports allows to adapt the mode of operation of the hydraulic machine to the specific needs also of hydraulic motors with variable displacement in such a way as to considerably improve operation with minimum displacement.

In conclusion, the most evident advantages are achieved with one single distributor body for each cylinder that is made mobile and balanced in the thrusts to which it is subject, but further and more significant advantages are obtained with the shape of the edge of the ports, as described above.

Obviously, an expert of the sector, in order to meet specific needs, may bring several changes to the above-described hydraulic machine with oscillating radial cylinders and single distribution members for each cylinder, all included within the scope of protection of the present invention as defined by the following claims. Thus, even if less conveniently, thanks to the subdivision of the back surface of a distributor body into central zone and peripheral zone each zone can be connected to a respective single port in correspondence of and operating with on single slit in the head of the cylinder involved.

Moreover, even if less conveniently for production costs, the surface of distribution in addition to the cylindrical shape shown can also be of a convex, barrel-like or even spherical shape, so in combination with the sizing of the zones of pressure of the back surface of the distributor body the contact and the liquid tightness of the distributor is improved.

Furthermore, the distributor body can be made with one single port and associated with a surface of distribution of a trunnion provided with a connection channel with the cylinder, similarly to what is shown in FIG. 8, but with both trunnions provided with a channel, with a respective slit centred in the position corresponding to the dead centres of the oscillating piston-cylinder complex, which connect the cylinder with annular ducts one on each side of the crown of cylinders. The distributor body for a similar realization has only one port angularly placed on the surface of rotation and distribution in such a way as to realize one of the overlap positions described in FIG. 17*a-c* or 18*a-d* and on the other distributor body with single port the corresponding port to realize the described positioning between the ports and the slit.

Moreover, an internal cam, like the cam 34 of the hydraulic machine of FIG. 6 or 7, can be made with several protuberances to realize several cycles of a single cylinder in the single rotation of the hollow motor shaft 35. Finally, said internal cams in the case of a multiple crown of cylinders can be angularly offset in such a way as to increase the number of the thrust pulses and generate in a hydraulic motor a uniform torque.

The invention claimed is:

1. A hydraulic machine comprising:

a machine body including a plurality of cylinder-piston units including:

oscillating radial cylinders; and pistons which are slidable on a crankshaft or with a cam, or on interposed members concentric to the crankshaft, and realize a reciprocating motion in the oscillating radial cylinders; and a single distributor body formed, on each cylinder, in a surface of distribution concentric or corresponding to a surface of oscillation of the respective cylinder, wherein said oscillating radial cylinders are put in contact with the surface of distribution on which each corresponding distributor body is placed, separate from the machine body and housed in a seat in the machine body, or part fixed to the machine body, of the hydraulic machine, wherein each distributor body is mobile in its seat under the action of a liquid pressure acting on a back surface of said distributor body to be pressed against the surface of distribution of the oscillating radial cylinder subject to the distribution of the corresponding distributor body, and wherein each distributor body comprises:

a plurality of shaped ducts formed in the back surface of the distributor body; and a plurality of ports of distribution forming a passage for the liquid from the shaped ducts to a slit in the respective cylinder.

2. The hydraulic machine according to claim 1, wherein the back surface, with respect to said surface of distribution, of each distributor body is divided into liquid tight zones, each zone having an equivalent surface area, in order not to influence tightness according to a direction of a motion of the liquid.

3. The hydraulic machine according to claim 2, wherein said liquid tight zones, of the back surface of each distributor body, are made concentric and subdivided into a central zone and a peripheral zone.

4. The hydraulic machine according to claim 1, wherein the slit comprises a pair of slits, and each cylinder includes the pair of slits for the connection of a branch of the hydraulic circuit to one or the other corresponding pair of distribution ports for the connection of a branch of the hydraulic circuit, each pair of slits being made interposed and with an angular position relative to the axis of the cylinder corresponding to the maximum oscillation in the operation of the oscillating radial cylinder allowed to the machine.

5. The hydraulic machine according to claim 2, wherein a shaped duct of the plurality of shaped ducts is formed between the respective liquid tight zone and each port of the plurality of ports and comprises a hole with a predetermined cross-section.

6. The hydraulic machine according to claim 1, wherein each cylinder is hydraulically connected by means of a respective distributor body to annular channels for feeding the liquid from one channel, and discharging the liquid to another channel.

7. The hydraulic machine according to claim 1, wherein each cylinder is hydraulically connected by means of a respective distributor body to internal channels of feeding and discharge of the liquid from a static central body.

8. The hydraulic machine according to claim 1, wherein the ports of feeding or discharge in each distributor body have a protuberance of advance or delay in the opening or closing of the passage of the liquid of the distribution.

9. The hydraulic machine according to claim 1, wherein the ports are shaped with an edge facing the slit in the cylinder that has a swell whereby sections of passage of the liquid are variable with the variation of the angle of oscillation, in the hydraulic machine operated with reduced displacement.

10. The hydraulic machine according to claim 1, wherein the oscillating radial cylinders include a trunnion, and the hydraulic machine has a connection channel in the trunnion.

11. A hydraulic machine comprising:

a machine body;

a plurality of cylinder-piston units formed in the machine body, and including a plurality of radial cylinders and a plurality of pistons which are slidable on a crankshaft to realize a reciprocating motion in the radial cylinders;

a plurality of distributors formed on the plurality of radial cylinders respectively, a distributor of the plurality of distributors being formed in a surface of distribution corresponding to a surface of oscillation of the respective radial cylinder of the plurality of radial cylinders, wherein a radial cylinder of the plurality of radial cylinders is in contact with the surface of distribution on which the distributor is placed, separate from the machine body and housed in a seat in the machine body, wherein each distributor of the plurality of distributors is mobile in the seat under the action of a liquid pressure acting on a back surface of the distributor against the surface of distribution of the corresponding radial cylinder, and wherein the distributor comprises:

a plurality of shaped ducts formed in the back surface of the distributor; and a plurality of ports of distribution forming a passage for the liquid from the shaped ducts to a slit in the respective radial cylinder.

12. The hydraulic machine according to claim 11, wherein the back surface of the distributor is divided into a plurality of liquid tight zones each having an equivalent surface area, in order not to influence tightness according to a direction of motion of the liquid.

13. The hydraulic machine according to claim 12, wherein a shaped duct of the plurality shaped ducts is formed between the respective liquid tight zone and a corresponding port an comprises a hole with a predetermined section.

14. The hydraulic machine according to claim 11, wherein each radial cylinder of the plurality of radial cylinders is hydraulically connected by means of the respective distributor body to annular channels, for feeding the liquid from one channel, and discharging the liquid to another channel.

* * * * *